US005213155A

United States Patent [19]

Hahn

[11] Patent Number: 5,213,155

[45] Date of Patent: May 25, 1993

[54] METHOD AND APPARATUS FOR MULTIPLE LOCKING A SINGLE ROW OF HEAT EXCHANGER TUBES

[75] Inventor: Robert B. Hahn, Virginia Beach, Va.

[73] Assignee: The Atlantic Group, Inc., Norfolk, Va.

[21] Appl. No.: 872,316

[22] Filed: Apr. 23, 1992

[51] Int. Cl.[5] ..... F28F 9/00

[52] U.S. Cl. ..... 165/162; 122/510; 248/68.1

[58] Field of Search ..... 165/69, 162; 122/510; 248/68.1

[56] References Cited

U.S. PATENT DOCUMENTS

| | | | |
|---|---|---|---|
| 1,430,769 | 10/1922 | Thompson | 165/162 |
| 1,882,474 | 10/1932 | Black | 165/162 |
| 2,126,687 | 8/1938 | Martin | 165/162 |
| 2,198,529 | 4/1940 | Fields | 165/162 |
| 2,271,648 | 2/1942 | Kleist | 165/162 X |
| 2,980,404 | 4/1961 | Andersen et al. | 165/172 |
| 3,180,406 | 4/1965 | Oechslin | 165/162 |
| 3,495,556 | 2/1970 | Steever et al. | 165/162 |
| 3,616,849 | 11/1971 | Dijt | 165/159 |
| 3,924,676 | 12/1975 | Bennett | 165/172 |
| 4,013,024 | 3/1977 | Kochey, Jr. et al. | 122/510 X |
| 4,014,314 | 3/1977 | Newton | 165/162 X |
| 4,054,980 | 10/1977 | Roma | 165/172 X |
| 4,064,866 | 12/1977 | Knight, Jr. | 165/172 X |
| 4,095,648 | 6/1978 | Shipes | 165/162 |
| 4,337,827 | 7/1982 | Jabsen | 165/172 |
| 4,384,697 | 5/1983 | Ruhe | 248/68.1 |
| 4,456,058 | 6/1984 | Powell | 165/154 |
| 4,589,618 | 5/1986 | Fournier | 248/68.1 |
| 4,648,442 | 3/1987 | Williams | 165/162 |
| 4,702,311 | 10/1987 | Bizard | 165/162 |
| 4,749,031 | 6/1988 | Fukumoto | 165/159 |
| 4,771,825 | 9/1988 | Chen et al. | 165/151 |
| 4,860,697 | 8/1989 | Malaval | 122/510 |
| 4,919,199 | 4/1990 | Hahn | 165/162 |
| 4,991,645 | 2/1991 | Lagally et al. | 165/69 |
| 5,016,706 | 5/1991 | Dimarco et al. | 165/162 |
| 5,033,542 | 7/1991 | Jabs | 165/162 |
| 5,050,669 | 9/1991 | Nenstiel et al. | 165/162 |
| 5,052,474 | 10/1991 | Bronnert | 165/67 |
| 5,072,786 | 12/1991 | Wachter | 165/69 |
| 5,083,346 | 1/1992 | Orton | 24/16 PB |

FOREIGN PATENT DOCUMENTS

| | | | |
|---|---|---|---|
| 078728 | 5/1983 | European Pat. Off. | 122/510 |
| 63-180092 | 7/1988 | Japan | 165/162 |
| 52981 | 3/1942 | Netherlands | 165/162 |

*Primary Examiner*—Allen J. Flanigan

*Attorney, Agent, or Firm*—Fitzpatrick, Cella, Harper & Scinto

[57] ABSTRACT

A method and apparatus for locking a single row of transversely extending parallel tubes. The open end of a U-shaped stake, comprising first and second strip portions elongated in the longitudinal direction with a connecting portion at one end, longitudinally is inserted so as to engage at least the outer surface of a tube located at one end of the row. The stake then is fastened to said row by encircling, in at least one substantially transverse plane, the outer surfaces of each strip portion. The encircling occurs in at least one longitudinal location along said stake that is between adjacent tubes of said row, and locally deforms the stake to further secure the stake against the row of tubes.

12 Claims, 2 Drawing Sheets

METHOD AND APPARATUS FOR MULTIPLE LOCKING A SINGLE ROW OF HEAT EXCHANGER TUBES

BACKGROUND OF THE INVENTION

1. Field of Invention: A method and apparatus based upon a tube stake that embraces and dampens vibrations in a single row of heat exchanger tubes. The stake is U-shaped, comprising two elongated strip portions of a soft V configuration, joined at one end by a connecting clamp, and a plurality of encircling metal tie fasteners.

2. Brief Description of the Prior Art: Tubes are arranged in bundles within heat exchangers and condensers. The array of tubes is prone to sympathetic vibration and movement, as a consequence of temperature increases and as a result of fluid velocity and density changes both inside and outside of the tubes. Such vibrations have an oscillatory nature, and the oscillations can reach critical amplitudes and severely damage the tubes.

This well-known problem has become more critical within condensers or heat exchangers wherein tubes originally comprised of admiralty brass, or other relative stiff materials, are replaced with lighter weight noble metal materials, such as titanium. A Design Guide published by the Heat Exchange Institute, 8th Edition, provides structural standards for different tubing materials, and particularly a maximum mid-span spacing between support plates perpendicular to the center line of rows of tubes. By way of background, a permitted mid-span spacing between support plates typically is on the order of between 30 inches and 50 inches, depending upon the inherent properties of the tube material, and various other design parameters such as pitch between center lines of each tube and the operating conditions of the condenser or heat exchanger.

Tubes primarily are held within tube support plates, at each end and at spaced locations therebetween. Since about 1955, with the advent of multi-spindle drills, a large number of holes typically are drilled at one time, in each tube support plate. The support plates are then spaced longitudinally along the tubes, so as to define several bays. Steam condensers typically are constructed so that the tube support plates space the tubes at apices of an equilateral triangle, with the center line distance between adjacent tubes being equal, in any direction. In that circumstance a tube stake such as that disclosed in WILLIAMS (U.S. Pat. No. 4,648,442) or HAHN (U.S. Pat. No. 4,919,199) can be inserted between lanes of tubes, in order to dampen vibrations through a coaction between adjacent tube rows.

However, due to the design of certain heat exchangers, and particularly at outer peripheries of a tube bundle, it often also is necessary to stabilize a single row of tubes. Where a plurality of tubes in a single row is not adjacent a parallel row of tubes, on at lest one side, it is not possible to stiffen that single row by a conventional tube stake.

It also generally is known that a set of parallel plates, or a U-shaped metal strip member, can be used to clamp around a single row of heat exchanger tubes. NEWTON (U.S. Pat. No. 4,014,314) illustrates a U-shaped clamp with a connector comprising an end piece, that engages the free ends of each connected strip. JABS (U.S. Pat. No. 5,033,542) illustrates a trelliswork that is woven transversely across a row of parallel tubes and then is secured, at each free end, to the frame of a heat exchanger. BIZARD (U.S. Pat. No. 4,702,311) illustrates a flexible, U-shaped pipe that is inserted flat and then inflated to stiffen adjacent rows of tubes. THOMPSON (U.S. Pat. No. 1,430,769) illustrates a single row of transformer coils that are braced between a pair of flat bars, with several bolts interconnecting the flat bars. KOCHEY, Jr. et al. (U.S. Pat. No. 4,013,024) illustrates a slotted band type spacer, wherein weldments and tie rods are used to position flat plates on either side of a row of superheater tubes. NENSTIEL et al (U.S. Pat. No. 5,050,669) illustrates a tube support comprising a pair of parallel plates secured transversely over a set of parallel tubes, and joined by a plurality of staggered pins.

BRIEF SUMMARY OF THE INVENTION

The present invention comprises an improved tube anti-vibration stake that generally is U-shaped and is configured for use in combination with one or more encircling band fasteners. The stake comprises two longitudinally elongated, generally parallel and inwardly open strip portions of a soft V configuration. Each strip is interconnected at one end by a surrounding clamp portion. The soft V is defined by a longitudinal bend proximate the midpoint of each strip, wherein transversely extending legs terminate at a land section running longitudinally along the distal sides of each strip. For convenient reference to relative directions, the terms first direction, x-axis and longitudinal are equivalent; the terms second direction, y-axis, and transverse are equivalent; and the terms third direction, z-axis, and normal are equivalent.

Each strip has a transverse cross section, along a normal plane at a given longitudinal location, that is defined by a continuous soft V apex band, on the outer surface, and a pair of continuous lands with a plurality of saddles separated longitudinally by ligaments, on the inner surface. In that respect, each strip portion of the present invention is configured in the same general manner as illustrated for a multiple locking stake in my prior patent, HAHN (U.S. Pat. No. 4,919,199), and that specification is incorporated herein, by reference. Hence, all or part of each strip portion of a stake according to the present invention also longitudinally can be engaged in a lane dimension between transversely adjacent rows of tubes, so as to function as a multiple locking stake.

At one end of the stake a surrounding clamp portion acts as a connecting portion to join the two strip portions in a substantially parallel relationship, whereby the engaging inner surfaces of each strip are facing. Opposed saddles longitudinally are spaced along each inner surface, in planar land portions that are located along distal edges of each strip. Hence, a single row comprising a plurality of transversely extending, parallel tubes can be engaged between the two strips, and located by a contact with the set of saddles and the surrounding clamp portion. Between each saddle the land portion extends as a flat ligament section, that initially is flat and disposed in an x-y plane. When a metal tie fastener tightly is encircled, in an y-z plane, around opposed ligament sections at a given longitudinal location, those ligaments locally are deformed by a hoop stress imparted from the loop formed by a tie. That hoop stress also locally deforms the apex of the soft V band, on the outer surface of each strip portion. These deformations tend to prevent movement of the tie on the stake, and tend to further lock the stake with respect to the engaged tubes.

The present invention permits rapid and custom stake configuration changes for a large range of heat exchanger tube configurations, without separate dies required to form a totally new configuration. The tube bundle variables initially set are tube diameter, number of tubes and pitch dimension between each tube in a single row. The degree of interference fit desired with respect to a lane dimension, if there is any adjacent row of tubes to engage, thereafter quickly can be adjusted by changing the width of the metal strip, and the included angle between side walls.

A first object of the present invention is to provide a tube stake method and apparatus that can be used to quickly and easily stabilize or lock together a single row of tubes, without relying on an adjacent row of tubes for support.

A second object of the present invention is to provide a tube stake apparatus that comprises a single metal strip and one or more encircling fasteners, and does not require internal tie rods or bolts to secure the stake in a fixed position on a single row of tubes.

A third object of the present invention is to provide a tube stake apparatus that can lock together a single row of tubes, while also engaging an adjacent row of tubes for additional support.

A fourth object of the present invention is to provide a tube stake formed of a single metal strip, that easily can be configured by bending for different applications, without need for dies or expensive retooling.

For a further understanding of these and other objects and advantages of the present invention, a preferred embodiment hereafter is described, wherein reference is made to the accompanying drawings.

DESCRIPTION OF THE PREFERRED EMBODIMENT

Figure 1:
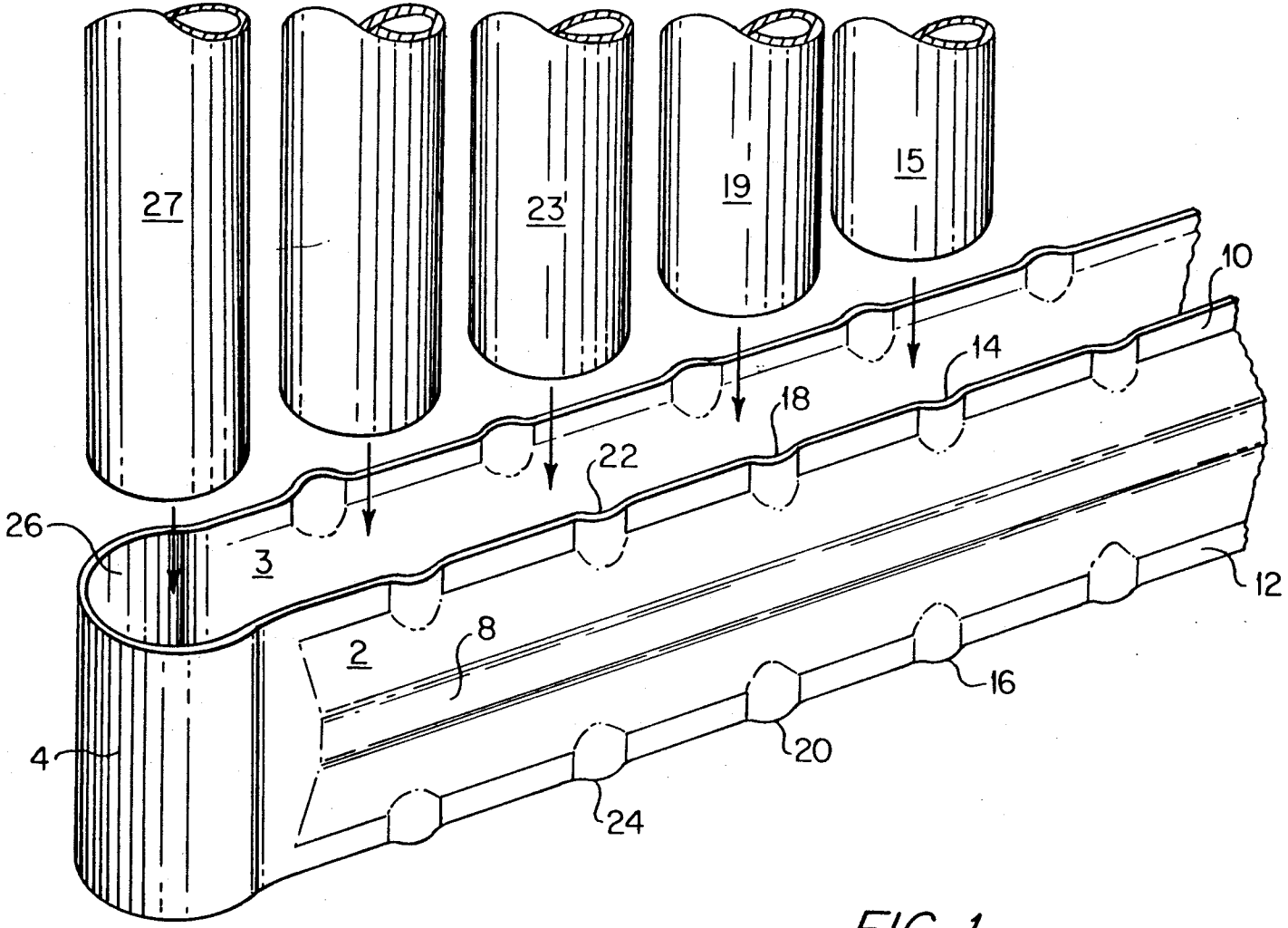
FIG. 1 is a right side elevation view, in perspective and in partial section, of a preferred stake for practice of the invention, wherein a set of tubes are shown in an explosion position.

FIG. 1 is a perspective view of a preferred stake component according to the present invention, wherein a set of tubes is shown in an explosion relation, so that the inner surfaces of the stake more readily can be appreciated. The stake comprises mirror image right and left strip portions, 2, 3 which are in a substantially parallel relationship with tube engaging inner surfaces that are facing. Since the strip portions 2, 3 are equivalent, and are spaced about an x-y plane of symmetry of the stake, only characteristics of the right side strip portion 2 will be discussed in detail. The stake generally is elongated along an x-axis, or in a longitudinal direction. The strip portions are connected at one end by a clamp portion 4, so as to define a U-shaped stake with an inner surface configuration adapted to engage outer surfaces of a plurality of parallel tubes that extend along a y-axis, or in a transverse direction.

Figure 2:
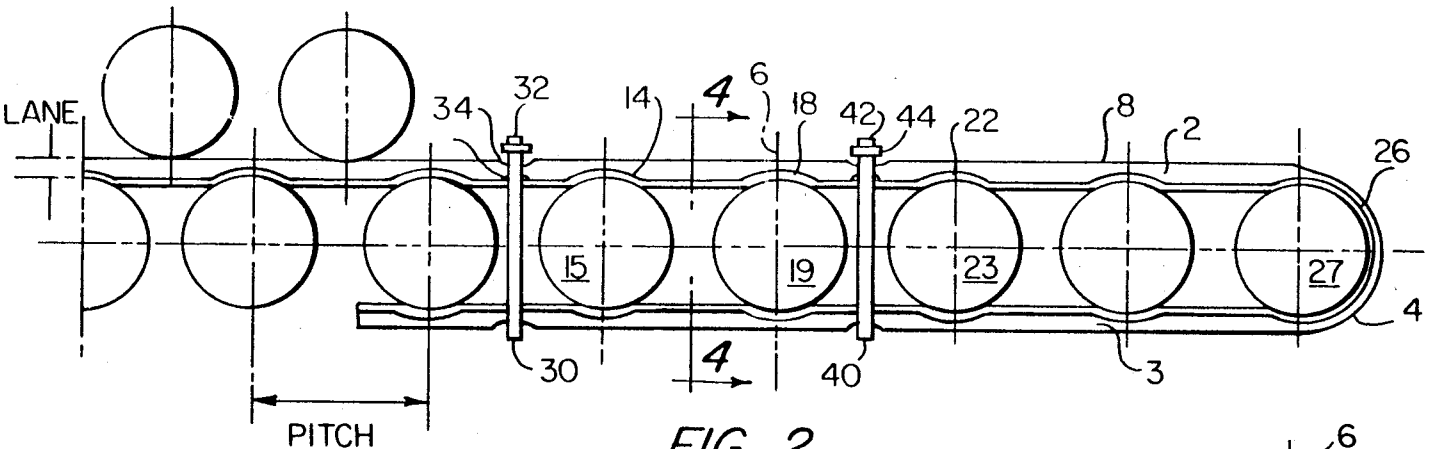
FIG. 2 is a top plan view, in partial section, of the stake shown in FIG. 1 when used in combination with metal tie fasteners according to the present invention.
Figure 3:
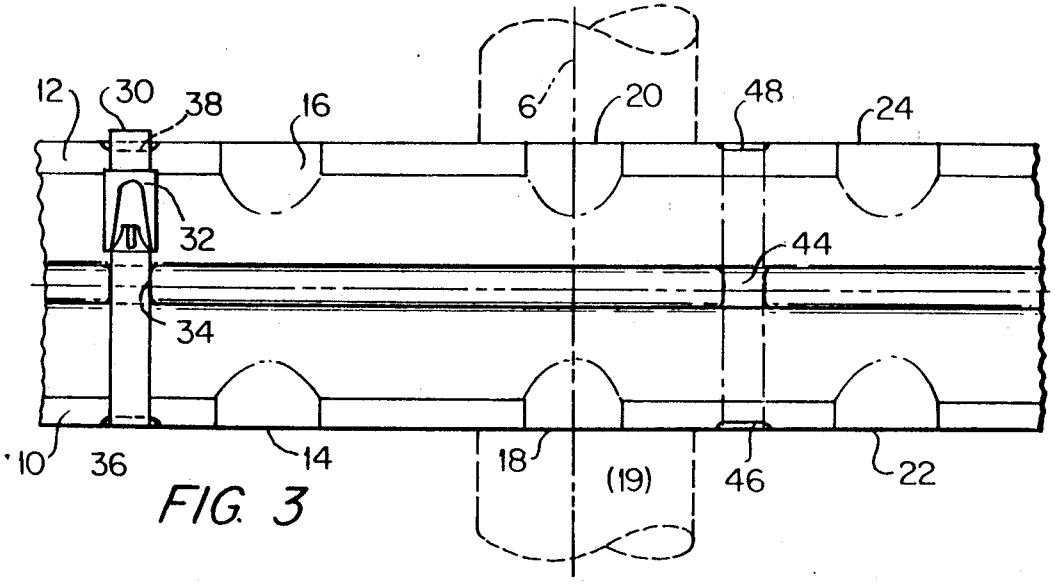
FIG. 3 is a cross section vertical elevation, end view, taken along line AA of FIG. 2.

A plurality of saddles are arranged on lands 10, 12 which define the distal edges of the right side strip portion 2. A soft V bend will define a longitudinally extending band 8 that is located proximate the middle of the right and left side strip portions. FIGS. 1 and 2 show how the saddle pairs, 14 and 16; 18 and 20; 22 and 24 are spaced longitudinally by a dimension which is equivalent to the pitch between each of the tubes 15, 19, 23 that are to be engaged. The lands 10, 12 are planar and extend as ligaments between each set of saddles, as shown in FIGS. 1, 2 and 3. The curved surface defining each saddle makes a smooth transition to a ligament on each side, and also a smooth transition to the inclined surface that was formed by bending the strip portion into a soft V. This configuration facilitates driving the stake in a Lane, past the tubes and into the desired engagement position. The radii of curvature of each saddle is preferrably at least equal to, and preferably slightly greater than, the outer radii of curvature of the tubes to be engaged. Likewise, connecting portion 4 has a radius of curvature slightly greater than that of the tubes.

The preferred strip material is stainless steel, such as ANSI type 304 stainless steel, and typically has a thickness between 0.028 inches and 0.035 inches. The metal strip preferably has an unbent width of approximately 1.00 to 2.00 inches, and is bent into a soft V configuration with an included angle of about 100 degrees to 160 degrees. The stake of the preferre embodiment is formed from a single flat strip of stainless steel that first is bent to define the clamp portion 4. Alternatively, the clamp bending and the soft V bending may occur in a single forming step.

The soft V bending defines a central region band that initially will be substantially flat, or have a slight arcuate configuration. The soft V configuration preferably defines a longitudinally extending midpoint in each strip portion that is a band with an outer surface 8 having a transverse dimension preferably between 0.083 inches and 0.25 inches, when measured as a horizontal projection.

Either simultaneous with the bending step, or thereafter in a separate forming step, transverse saddles are defined with a center line spacing exactly equivalent to the pitch of the row of tubes over which the stake will driven. FIG. 1 shows, in explosion view, how the saddle pitch matches the distance between center points of adjacent tubes. As further shown by FIGS. 2 and 3, the radius of curvature for each saddle is not less than, and preferably is greater than, the radius of curvature of the tube against which it will engage. Further, each saddle has a smooth transition to the ligament between each saddle, to facilitate longitudinal driving of a stake past a large number of tubes, if an adjacent row of tubes also is to be engaged, as in FIG. 2. Typically, a single tube row will have twenty or more tubes against which the stake leading edge sequentially will pass over, before coming to rest against the last tube in the row.

A metal tie fastener, 30, 40, is used to apply hoop stress against each ligament and the outer surface of each strip portion, between selected tubes. The hoop stress is exerted in an y-z plane, and is applied equally to both the upper and lower elongated strip portions so as to squeeze the two strip portions together against the row of tubes, as illustrated in FIG. 2. The metal tie fastener has a ratchet lock portion 32, 42, that preferably is located so as to be exposed, against one side of the stake. The hoop stress causes a local deformation, 34, 44 in the soft V proximate portion of each strip, as well as a local deformation 36, 46 at the distal end in the ligament portion of each strip. FIG. 3 shows such deformations, with the tie fastener 40 removed, for clarity.

A preferred metal tie fastener is made of stainless steel and has a minimum loop tensile strength of 100 pounds, such as Model No. MLT4S-CP, as manufactured by Panduit, of Tinley Park, IL. Such a tie first manually is applied around the strip portions between adjacent tubes, then an installation tool is used conventionally to tighten and cut off the free end of the tie. The fastened tie rests against only outside surfaces of the two strip portions. Accordingly, each tie remains readily accessible to cutting and removal by a worker wishing to remove the stake during a later retubing of a heat exchanger, for example.

Figure 4:
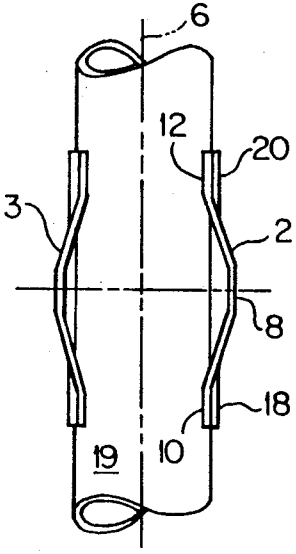
FIG. 4 is a right side elevation, detail view taken along line BB of FIG. 2.

FIG. 4 illustrates how the stake has a transverse cross section, along a normal plane taken at one longitudinal location, AA, as shown in FIG. 2. FIG. 2 also illustrates how the continuous soft V apex band, on the outer surface, is configured to coact with a plurality of saddles, on the inner surface, for a resilient fit in a Lane dimension between adjacent rows of tubes. In that respect, each strip portion of the present invention is configured to permit a multiple locking as in HAHN (U.S. Pat. No. 4,919,199). Hence, if a single tube row extends out of a tube bundle, in the manner shown in FIG. 2, the stake can also be anchored at one end against the tube bundle, for adding further stiffness to the single tube row. Such an option is a significant advantage, since all condensers will have outer rows of tubes. Further, condensers often have a single tube row that extends outwardly from a tube bundle in a first direction, and the present stake creates an opportunity to stiffen such a row by a cantilever effect.

The preceding embodiment describes only a section of a stake according to the present invention. In practice, the stake may be longer and contain many more sets of saddles and ligaments, and require many more tie fasteners to properly squeeze the right and left elongated strip portions together against a single row of tubes. The preceeding embodiment has the pair of strip portions and the connecting clamp portion formed from a single flat strip of stainless steel, and metal tie fasteners as the encircling means. However, the invention may be embodied through additional or equivalent components.

Although the preceding embodiment addresses a situation where pitch and tube dimension are constant, it will be recognized that a stake according to the present invention also could be constructed to operate on a row of tubes with variable pitch or variable tube dimensions. This could be accomplished most simply by varying saddle spacing or radii of curvature.

Those skilled in the art will recognize further additions and modifications that can be made to the invention without departing from the spirit of the invention. The invention is to be defined solely by the scope of the appended claims.

I claim:

1. A U-shaped stake apparatus for locking a single row of transversely extending parallel tubes, said apparatus comprising in combination:

a first elongated strip portion having a longitudinal axis, a bend along said longitudinal axis so as to define a proximate stake midpoint and transversely extending legs that terminate at distal ends;

a second elongated strip portion having a longitudinal axis, a bend along said longitudinal axis so as to define a proximate stake midpoint and transversely extending legs that terminate at distal ends;

a connecting portion that joins said first and second strip portions, and is adapted to engage the outer surface of a transversely extending tube located therein;

a land portion proximate to the distal end of each strip portion that comprises a plurality of saddles having a curvature adapted to engage the outer surface of a transversely extending tube, said saddles being separated longitudinally by ligament portions; and, fastener means adapted to encircle opposed ligament portions of said stake, in a substantially transverse plane and thereby lock said stake with respect to a single row of tubes located between said first and second strip portions.

2. A stake according to claim 1, wherein said first and second strip portions and said connecting portion are defined by a single stainless steel metal strip.

3. A stake according to claim 1, wherein said proximate stake midpoint is defined by a soft V bend in a single stainless steel metal strip.

4. A stake according to claim 1, wherein said fastener means adapted to encircle opposed ligament portions of said stake further comprises a stainless steel loop and ratchet fastener that locally deforms said ligament and locally deforms a longitudinal band at said proximate stake midpoint, upon being tightened after encircling opposed ligaments of said stake.

5. A stake according to claim 1, wherein said saddles each have a curvature slightly larger the outer surface of a transversely extending tube that is intended to be engaged by that saddle, and the ligament portions separating said saddles are substantially planar.

6. A stake according to claim 1, wherein said proximate stake midpoint is defined by a soft V bend in a single stainless steel metal strip and each strip portion defines an included angle between transversely extending legs that is between approximately 100 degrees and 160 degrees.

7. A stake according to claim 1 wherein the connecting portion that joins said first and second strip portions further comprises an inner surface with a radius of curvature slightly larger than the radius of curvature to the outer surface of a transversely extending tube intended to be engaged therein.

8. A stake according to claim 1 wherein said saddles are separated longitudinally by substantially uniform ligament portions.

9. A stake according to claim 1 wherein said saddles have inner surfaces adapted to engage a row of tubes of substantially uniform spacing and substantially uniform outer diameter.

10. A method for locking a single row of transversely extending parallel tubes, said method comprising the steps of:

A. inserting the open end of a U-shaped stake, further comprising first and second strip portions elongated in the longitudinal direction with a connecting portion at one end, longitudinally over said single row of transversely extending parallel tubes;

B. engaging an inner surface of said connecting portion against the outer surface of a transversely extending tube located at one end of said row; and C. fastening said stake to said row by encircling, in a substantially transverse plane, the outer surfaces of each strip portion, said encircling being in at least in one longitudinal location along said stake that is between adjacent tubes of said row.

11. A method according to claim 10, wherein said first and second strip portions further comprise a plurality of saddles separated by planar ligament portions and the step of inserting the open end of a U-shaped stake further comprises engaging each saddle against the outer surface of a transversely extending tube in said row.

12. A method according to claim 11, wherein said fastening step further comprises encircling a stainless steel loop and ratchet fastener upon said opposed planar ligament portions, and tightening said fastener so as to locally deform said ligaments.

* * * * *